US009512574B2

(12) United States Patent
Kim et al.

(10) Patent No.: US 9,512,574 B2
(45) Date of Patent: Dec. 6, 2016

(54) METHOD FOR CONSTRUCTING CONTINUOUSLY REINFORCED CONCRETE PAVEMENT USING REINFORCING STEEL INTRODUCING/FIXING EQUIPMENT

(71) Applicant: SAM WOO INNOVATION MAINTENANCE CONSTRUCTION CO., LTD., Chuncheon-si, Gangwon-do (KR)

(72) Inventors: Ki Heun Kim, Seoul (KR); Jong Oh Bae, Seoul (KR); Yong Su Kil, Seoul (KR); Beom Jun Chon, Seoul (KR); Jung Shik Yang, Seoul (KR); Moon Cheol Won, Seoul (KR); Pan Gil Choi, Chuncheon-si (KR)

(73) Assignee: SAM WOO INNOVATION MAINTENANCE CONSTRUCTION CO., LTD., Chuncheon-Si, Gangwon-Do (KR)

( * ) Notice: Subject to any disclaimer, the term of this patent is extended or adjusted under 35 U.S.C. 154(b) by 0 days.

(21) Appl. No.: 14/433,987

(22) PCT Filed: Oct. 10, 2013

(86) PCT No.: PCT/KR2013/009065

§ 371 (c)(1),
(2) Date: Apr. 7, 2015

(87) PCT Pub. No.: WO2014/058246

PCT Pub. Date: Apr. 17, 2014

(65) Prior Publication Data

US 2015/0259862 A1 Sep. 17, 2015

(30) Foreign Application Priority Data

Oct. 12, 2012 (KR) ..... 10-2012-0113529

(51) Int. Cl.
*E01C 9/00* (2006.01)
*E01C 11/20* (2006.01)

(Continued)

(52) U.S. Cl.
CPC ..... *E01C 11/20* (2013.01); *E01C 7/14* (2013.01); *E01C 9/001* (2013.01); *E01C 11/16* (2013.01); *E01C 11/18* (2013.01); *E01C 23/04* (2013.01)

(58) Field of Classification Search
CPC ..... E01C 7/11; E01C 9/001; E01C 11/16; E01C 11/18; E01C 11/20; E01C 23/04
USPC ..... 404/72, 75, 100–102, 113–116
See application file for complete search history.

(56) References Cited

U.S. PATENT DOCUMENTS 3,331,296 A * 7/1967 Perkins ..... E01C 23/04 404/100
3,566,758 A * 3/1971 Perkins ..... E01C 23/04 404/100

(Continued)

FOREIGN PATENT DOCUMENTS

JP 07-180106 A 7/1995
JP 10-131130 A 5/1998

(Continued)

OTHER PUBLICATIONS

Search Report for International Application No. PCT/KR2013/009065.

*Primary Examiner* — Raymond W Addie
(74) *Attorney, Agent, or Firm* — LRK Patent Law Firm

(57) ABSTRACT

A method for constructing a continuously reinforced concrete pavement includes: the reinforcing steel bar arrangement step of moving reinforcing steel bar introducing/fixing equipment having guide tubes adapted to guide reinforcing steel bars to proper positions thereof and a reinforcing steel bar holding apparatus adapted to apply an instant tensile force to the reinforcing steel bars upon concrete casting to allow the reinforcing steel bars to be located at the proper positions thereof, and longitudinally arranging the reinforcing steel bars; the concrete casting step of casting concrete on top of the reinforcing steel bars arranged in the reinforcing steel bar arrangement step; and the finishing step of flattening the surface of the concrete cast in the concrete casting step by means of a paver.

9 Claims, 6 Drawing Sheets

(51) Int. Cl.

| | |
|---|---|
| ***E01C 7/14*** | (2006.01) |
| ***E01C 11/18*** | (2006.01) |
| ***E01C 11/16*** | (2006.01) |
| ***E01C 23/04*** | (2006.01) |

(56) References Cited

U.S. PATENT DOCUMENTS 3,611,890 A * 10/1971 Hudis ..... E01C 23/04 404/100
3,657,977 A * 4/1972 Hudis ..... E01C 23/04 404/100
3,678,816 A * 7/1972 Hudis ..... E01C 23/04 404/100
4,025,217 A * 5/1977 Cochrane ..... E01B 37/00 404/100
4,084,928 A * 4/1978 Petersik ..... B28B 1/084 404/100
4,312,602 A * 1/1982 Dale ..... E01C 23/04 404/100
4,636,110 A * 1/1987 Augoyard ..... E01C 23/04 404/100
5,135,333 A * 8/1992 Guntert, Sr. ..... E01C 23/04 404/100
6,293,728 B1 * 9/2001 Eggleton ..... E01C 19/4893 404/100
7,866,114 B2 * 1/2011 De La Cruz ..... E04C 5/20 404/135
2012/0282026 A1 * 11/2012 Atherton ..... E01C 19/15 404/82

FOREIGN PATENT DOCUMENTS

JP 2000-226810 A 8/2000
KR 10-1019761 B1 3/2011

* cited by examiner

METHOD FOR CONSTRUCTING CONTINUOUSLY REINFORCED CONCRETE PAVEMENT USING REINFORCING STEEL INTRODUCING/FIXING EQUIPMENT

TECHNICAL FIELD

The present invention relates to a method for constructing a continuously reinforced concrete pavement using reinforcing steel bar introducing/fixing equipment, and more particularly, to a method for constructing a continuously reinforced concrete pavement using reinforcing steel bar introducing/fixing equipment that is configured wherein the proper positions of longitudinal reinforcing steel bars can be secured, without transverse reinforcing steel bars and spacers during reinforcing steel bar arrangement, thus minimizing the amounts of the reinforcing steel bars and labor and improving the speed of construction, wherein concrete can be supplied from the side of a road or from the entire surface of the road during concrete casting, thus having no limitation in the working space, and wherein longitudinal reinforcing steel bars are not overlappingly joined with each other, thus reducing the amounts of reinforcing steel bars and labor needed for the overlapping joints and also minimizing the occurrence of damage in the joined portion of the longitudinal reinforcing steel bars.

BACKGROUND ART

A cement concrete pavement is configured to have a cement concrete slab resistant to shearing or bending generated from traffic loads to allow the stress caused by the load to be lowered than a supporting force of a lower course, thus maintaining structural stability. Generally, the cement concrete pavement includes a surface course and a subbase course, and the subbase course serves to supply equal supporting force to the slab, to previously prevent damages like pumping, and to provide safe working ground for casting concrete slab. The cement concrete pavements are generally classified into a jointed plane concrete pavement (JPCP), a jointed reinforced concrete pavement (JRCP), and a continuously reinforced concrete pavement (CRCP) in accordance with the reinforcement of the reinforced bar and joint spacing.

As shown in FIG. 1, the jointed plane concrete pavement is configured wherein there are no reinforced bars, except dowel bars or tie bars, and joints are equally spaced apart from each other, thus artificially controlling the positions of the occurrence of crack. If necessary, the dowel bars are arranged on the joints to help the transmission of load. In this case, no reinforcing bars exist on the entire portion except the joints in the jointed plane concrete pavement, and accordingly, the joints should be arranged to a given depth at appropriate timing so as to prevent crack from being generated from the entire portion except the joints.

The jointed plane concrete pavement causes riding quality to be deteriorated due to the breakage (stepped portions, corner crack, pumping, etc.) on the joints, so that longitudinal reinforcing steel bars are disposed on the center of the concrete slab, which is the jointed reinforced concrete pavement as shown in FIG. 2. The longitudinal reinforcing steel bars serve to prevent the crack generated due to the tensile force under the concrete slab from being excessively open. Accordingly, the jointed reinforced concrete pavement has the longer distance between the joints than the jointed plane concrete pavement, but still has the problem that structural breakage occurs on the joints and transverse crack portions.

As shown in FIG. 3, the continuously reinforced concrete pavement has a larger amount of longitudinal reinforcing steel bars than the jointed reinforced concrete pavement, thus completely removing the transverse joints. Since the continuously reinforced concrete pavement has no joints, it provides good riding quality and relatively long life span even under the heavy volume of traffic.

According to the conventional continuously reinforced concrete pavement, however, concrete is cast onto the reinforcing steel bars already arranged. As shown in FIG. 4, accordingly, the conventional continuously reinforced concrete pavement needs transverse reinforcing steel bars for supporting longitudinal reinforcing steel bars and spacers for supporting the transverse reinforcing steel bars so as to allow the longitudinal reinforcing steel bars to be located at the proper positions before concrete casting, thus undesirably increasing an amount of reinforcing steel bars consumed, requiring a large amount of labor due to manual operation, and reducing the whole construction speed.

Upon concrete casting, moreover, concrete is supplied just from the side of a road to be paved, so that it is hard to construct a pavement in small working space, such as, a concrete pavement into a tunnel, a tunnel entrance portion pavement, a bridge joint portion pavement, and a lane dividing section pavement, thus having many difficulties in domestic working environments.

According to the conventional continuously reinforced concrete pavement, further, the longitudinal reinforcing steel bars are overlappingly joined with each other, as shown in FIG. 5, so that a large amount of labor for the joining operation is consumed, and breakage on the road occurs well because the overlappingly joined portion and the concrete are not attached well to each other.

DISCLOSURE OF INVENTION

Technical Problem

Accordingly, the present invention has been made in view of the above-mentioned problems occurring in the prior art, and it is an object of the present invention to provide a method for constructing a continuously reinforced concrete pavement using reinforcing steel bar introducing/fixing equipment that is configured wherein longitudinal reinforcing steel bars can be automatically arranged in their proper positions, without having transverse reinforcing steel bars, thus minimizing the amounts of the reinforcing steel bars and labor and improving the speed of construction.

It is another object of the present invention to provide a method for constructing a continuously reinforced concrete pavement using reinforcing steel bar introducing/fixing equipment that is configured wherein concrete can be supplied from the side of a road as well as from the entire surface of the road during concrete casting, thus making it easy to construct a pavement in small working space, such as, a concrete pavement into a tunnel, a tunnel entrance portion pavement, a bridge joint portion pavement, and a lane dividing section pavement, without any limitation in the working space.

It is yet another object of the present invention to provide a method for constructing a continuously reinforced concrete pavement using reinforcing steel bar introducing/fixing equipment that is configured wherein longitudinal reinforcing steel bars are not overlappingly joined with each other, thus reducing the amounts of reinforcing steel bars and labor needed for the overlapping joining operation and also minimizing the occurrence of damage in the joined portion of the longitudinal reinforcing steel bars.

Solution to Problem

To accomplish the above-mentioned objects, according to the present invention, there is provided a method for constructing a continuously reinforced concrete pavement using reinforcing steel bar introducing/fixing equipment, the method including: the reinforcing steel bar arrangement step of moving reinforcing steel bar introducing/fixing equipment having guide tubes adapted to guide reinforcing steel bars to proper positions thereof and a reinforcing steel bar holding apparatus adapted to apply an instant tensile force to the reinforcing steel bars upon concrete casting to allow the reinforcing steel bars to be located at the proper positions thereof, without being bent even due to the weight of the concrete cast thereon, and longitudinally arranging the reinforcing steel bars; the concrete casting step of casting concrete on top of the reinforcing steel bars arranged in the reinforcing steel bar arrangement step; and the finishing step of flattening the surface of the concrete cast in the concrete casting step by means of a paver.

According to the present invention, preferably, the reinforcing steel bars are introduced serially into the guide tubes of the reinforcing steel bar introducing/fixing equipment in front of the reinforcing steel bar introducing/fixing equipment (in the driving direction thereof), and the reinforcing steel bars introduced into the guide tubes are partially bent outward from the center of a road to allow a given space portion to be formed in front of the reinforcing steel bar introducing/fixing equipment.

According to the present invention, preferably, at the given space portion formed in front of the reinforcing steel bar introducing/fixing equipment (in the driving direction thereof), a concrete spreader is located and driven along the road together with the reinforcing steel bar introducing/fixing equipment to allow the concrete to be cast on the reinforcing steel bars arranged behind the reinforcing steel bar introducing/fixing equipment.

According to the present invention, preferably, the reinforcing steel bars introduced into the guide tubes of the reinforcing steel bar introducing/fixing equipment in front of the reinforcing steel bar introducing/fixing equipment are continuously joined longitudinally with each other by means of couplers.

According to the present invention, preferably, the reinforcing steel bar holding apparatus of the reinforcing steel bar introducing/fixing equipment is driven in a roller or hydraulic pressure manner capable of applying the instant tensile force to the reinforcing steel bars.

According to the present invention, preferably, the guide tubes of the reinforcing steel bar introducing/fixing equipment become small in diameter as the guide tubes go toward the end portions thereof from which the reinforcing steel bars are guided and arranged, and otherwise, the guide tubes of the reinforcing steel bar introducing/fixing equipment become inclined upward from the horizontal plane of the road.

According to the present invention, preferably, the paver moving behind the reinforcing steel bar introducing/fixing equipment and the reinforcing steel bar introducing/fixing equipment are driven together, while being connected to each other so as to maintain a given distance therebetween.

According to the present invention, preferably, the reinforcing steel bar introducing/fixing equipment has flattening means mounted on the rear portion thereof so as to allow the concrete cast behind the reinforcing steel bar introducing/fixing equipment to be distributed transversely.

According to the present invention, preferably, the flattening means includes an auger or plower.

According to the present invention, preferably, at the reinforcing steel bar arrangement step, spacers are located in the transverse direction of the road to hold the proper positions of the reinforcing steel bars upon the initial arrangement of the reinforcing steel bars.

Advantageous Effects of Invention

As described above, the method for constructing a continuously reinforced concrete pavement according to the present invention is configured wherein the proper positions of the longitudinal reinforcing steel bars can be secured, without transverse reinforcing steel bars and spacers during reinforcing steel bar arrangement, thus minimizing the amounts of the reinforcing steel bars and labor and improving the speed of construction.

In addition, the method for constructing a continuously reinforced concrete pavement according to the present invention is configured wherein the concrete can be supplied from the side of the road or from the entire surface of the road during concrete casting, thus making it easy to construct a pavement in small working space, such as, a concrete pavement into a tunnel, a tunnel entrance portion pavement, a bridge joint portion pavement, and a lane dividing section pavement, without any limitation in the working space.

Further, the method for constructing a continuously reinforced concrete pavement according to the present invention does not need to overlappingly join the reinforcing steel bars with each other, thus reducing the amounts of reinforcing steel bars and labor needed for the overlapping joint and also minimizing the occurrence of damage in the joined portion of the longitudinal reinforcing steel bars.

BRIEF DESCRIPTION OF DRAWINGS

The above and other objects, features and advantages of the present invention will be apparent from the following detailed description of the preferred embodiments of the invention in conjunction with the accompanying drawings.

BEST MODE FOR CARRYING OUT THE INVENTION

Hereinafter, an explanation on a method for constructing a continuously reinforced concrete pavement using reinforcing steel bar introducing/fixing equipment according to the present invention will be in detail given with reference to the attached drawing.

According to the present invention, a method for constructing a continuously reinforced concrete pavement includes: the reinforcing steel bar arrangement step of moving reinforcing steel bar introducing/fixing equipment 100 having guide tubes adapted to guide reinforcing steel bars to proper positions thereof and a reinforcing steel bar holding apparatus adapted to apply an instant tensile force to the reinforcing steel bars upon concrete casting to allow the reinforcing steel bars to be located at the proper positions thereof, without being bent even due to the weight of the concrete cast thereon, and longitudinally arranging the reinforcing steel bars; the concrete casting step of casting concrete on top of the reinforcing steel bars arranged in the reinforcing steel bar arrangement step; and the finishing step of flattening the surface of the concrete cast in the concrete casting step by means of a paver 300.

Figure 1:
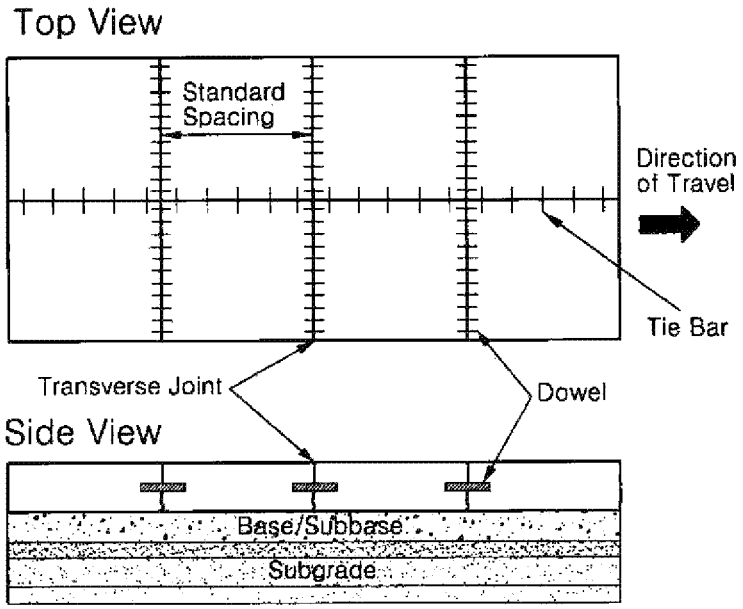
FIG.1 RELATED ART
FIG. 1 is top and side views showing a jointed plane concrete pavement.
Figure 2:
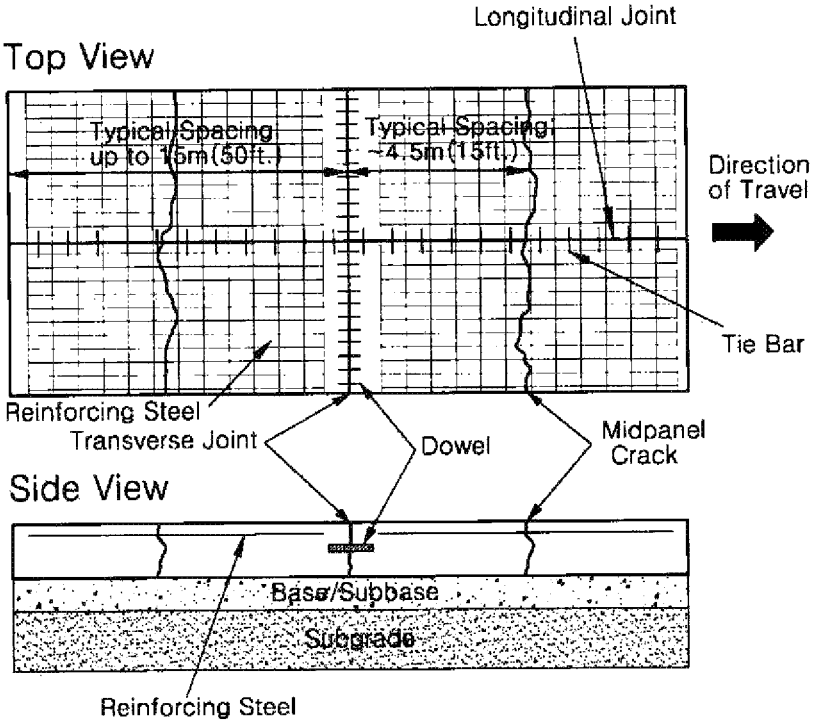
FIG.2 RELATED ART
FIG. 2 is top and side views showing a jointed reinforced concrete pavement.
Figure 3:
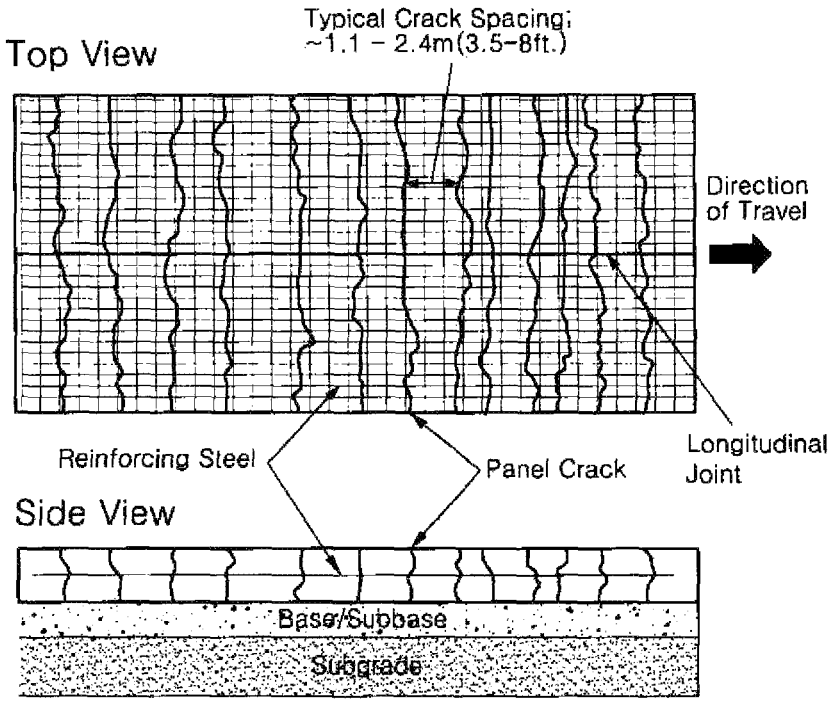
FIG.3 RELATED ART
FIG. 3 is top and side views showing a continuously reinforced concrete pavement.
Figure 4:
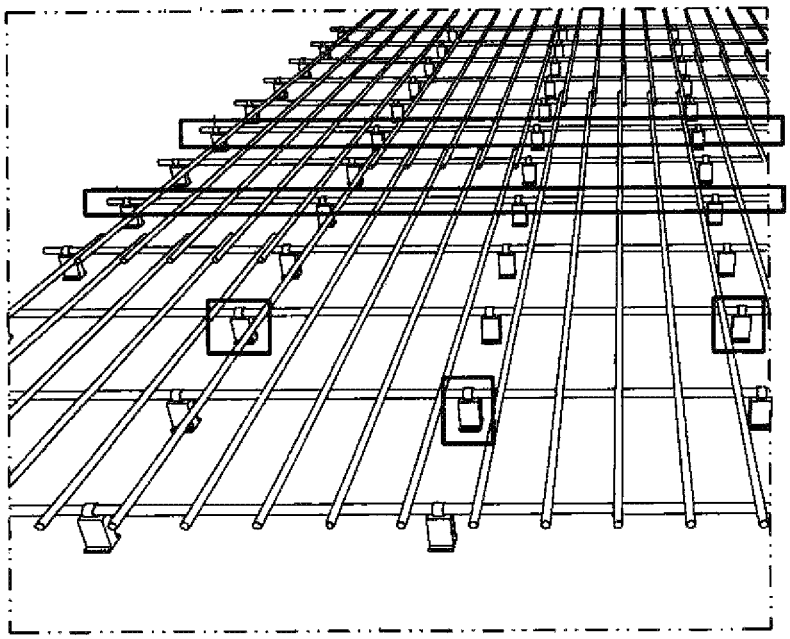
FIG.4 RELATED ART
FIG. 4 is a view showing the problems occurring in a conventional method for constructing a continuously reinforced concrete pavement, wherein transverse reinforcing steel bars are used to hold the proper positions of longitudinal reinforcing steel bars and spacers are used to support transverse reinforcing steel bars.

According to the conventional continuously reinforced concrete pavement, concrete is cast on pre-arranged reinforcing steel bars. Accordingly, transverse reinforcing steel bars are used to support the longitudinally arranged reinforcing steel bars to allow them to be located at their proper positions before the concrete casting, and spacers are used to support the transverse reinforcing steel bars (See FIG. 3).

Figure 6:
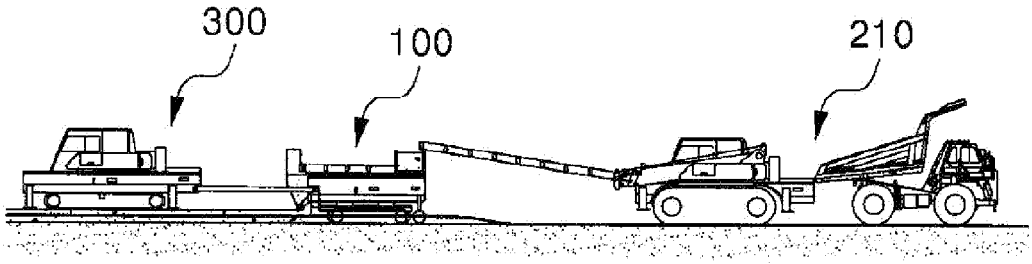
FIG. 6 is one concept view showing a method for constructing a continuously reinforced concrete pavement according to the present invention.

According to the present invention, as shown in FIG. 6, the method for constructing a continuously reinforced concrete pavement is configured wherein at the moment when the reinforcing steel bars are automatically arranged from the guide tube of the reinforcing steel bar introducing/fixing equipment 100, concrete is cast on top of the reinforcing steel bars by means of a concrete spreader 210 and the top surface of the cast concrete becomes flattened by means of the paver 300, so that there is no need for the separate transverse reinforcing steel bars, thus minimizing the amounts of the reinforcing steel bars and labor and shortening the time required for the pavement.

According to the present invention, that is, spacers are located in the transverse direction of a road to hold the proper positions of the reinforcing steel bars only upon the initial arrangement of the reinforcing steel bars. After that, the reinforcing steel bars are automatically continuously arranged, and at this time, the concrete casting and the finishing work are sequentially performed, so that no separate auxiliary reinforcing steel bars and spacers are required anymore.

At this time, the guide tubes are adapted to guide the reinforcing steel bars to allow them to be arranged at their proper positions, and they have various shapes so as to permit the reinforcing steel bars to be arranged at their proper positions within small error range. For example, the guide tubes become small in diameter as they go toward the end portions thereof from which the reinforcing steel bars are guided and arranged, and otherwise, they become inclined upward from the horizontal plane of the road because the reinforcing steel bars lag down during they are arranged on the road. In this case, desirably, the guide tubes have the inclination angle of 20° or under.

So as to prevent the reinforcing steel bars from being bent due to the weight of the concrete cast thereon after the reinforcing steel bars have been arranged from the guide tubes, according to the present invention, an instant tensile force is applied to the reinforcing steel bars upon concrete casting, so that the reinforcing steel bars can be arranged at their proper positions, without being bent. Unlike conventional reinforcing steel bar feeding equipment for just arranging the reinforcing steel bars randomly, the reinforcing steel bar introducing/fixing equipment 100 according to the present invention is provided with the reinforcing steel bar holding apparatus adapted to ensure the proper positions of the reinforcing steel bars, thus having no additional work using auxiliary reinforcing steel bars or spacers for the proper positions of the reinforcing steel bars.

At this time, the reinforcing steel bar holding apparatus can be driven in various manners capable of applying the instant tensile force to the reinforcing steel bars. For example, the reinforcing steel bar holding apparatus is driven in a roller manner wherein the reinforcing steel bars are moved between two rollers to apply an instant pressure to them, and otherwise, the reinforcing steel bar holding apparatus may be driven in a hydraulic pressure manner.

Figure 7:
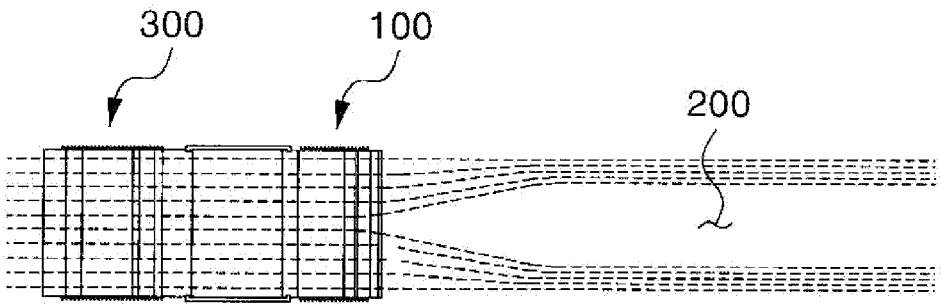
FIG. 7 is another concept view showing the method for constructing a continuously reinforced concrete pavement according to the present invention.

On the other hand, the reinforcing steel bars are introduced serially into the guide tubes of the reinforcing steel bar introducing/fixing equipment 100 in front of the reinforcing steel bar introducing/fixing equipment 100 in the driving direction thereof). At this time, as shown in FIG. 7, the reinforcing steel bars introduced into the guide tubes are partially bent outward from the center of the road to allow a given space portion 200 to be formed in front of the reinforcing steel bar introducing/fixing equipment 100.

According to the reinforcing steel bar feeding equipment used in the conventional continuously reinforcing steel bar concrete pavement, the longitudinal and transverse reinforcing steel bars are arranged, and next, the concrete pavement is conducted. In this case, it is impossible to perform the concrete casting on the entire surface of the road, and accordingly, the conventional continuously reinforcing steel bar concrete pavement cannot be conducted under a condition wherein a working space is relatively small. Further, since the construction is performed in the state where the reinforcing steel bars are linearly arranged, the concrete spreader should be stepped and moved on the reinforcing steel bars so as to feed the concrete onto the entire surface of the road.

Figure 8:
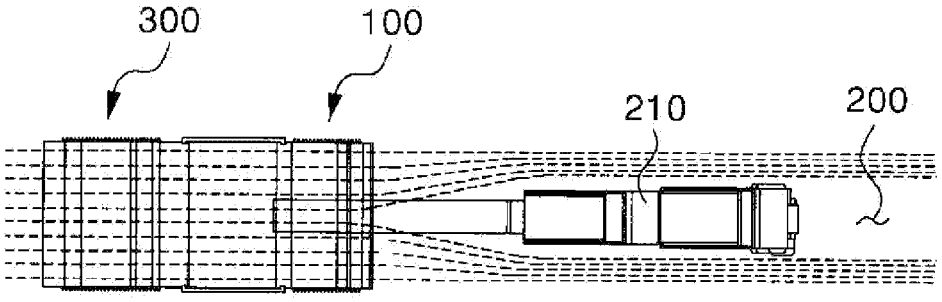
FIG. 8 is yet another concept view showing the method for constructing a continuously reinforced concrete pavement according to the present invention.

According to the present invention, however, the given space portion 200 is formed in front of the reinforcing steel bar introducing/fixing equipment 100, and the concrete spreader 210 is located at the given space portion 200. Accordingly, as shown in FIG. 8, the concrete spreader 210 is driven along the road together with the reinforcing steel bar introducing/fixing equipment 100 to allow the concrete to be cast on the reinforcing steel bars arranged behind the reinforcing steel bar introducing/fixing equipment 100.

In case where the pavement is constructed through the longitudinal driving of the reinforcing steel bar introducing/fixing equipment 100 and the concrete spreader 210, there is no spatial limitation in casting the concrete onto the surface of the road, unlike the conventional construction wherein the concrete is cast on the side of the road, thus making it easy to construct a pavement in small working space, such as, a concrete pavement into a tunnel, a tunnel entrance portion pavement, a bridge joint portion pavement, and a lane dividing section pavement.

Figure 5:
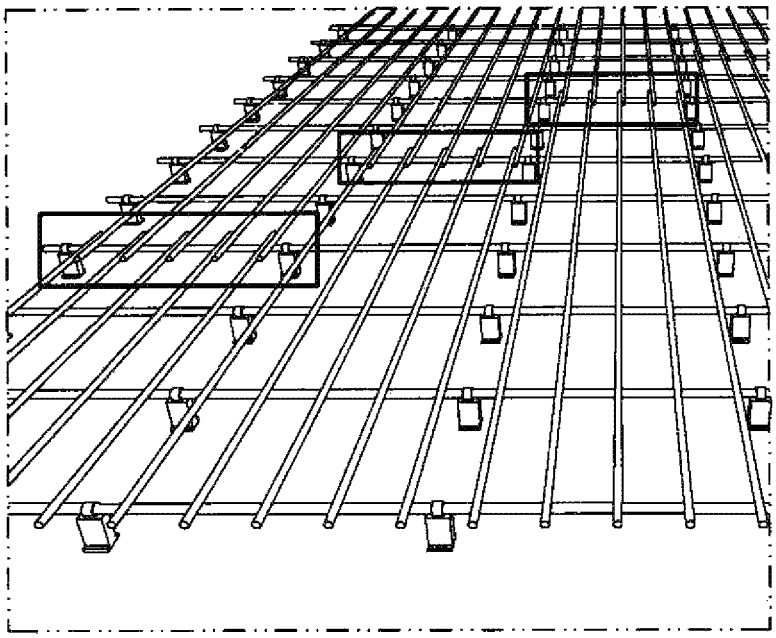
FIG.5 RELATED ART
FIG. 5 is a view showing other problems occurring in the conventional method for constructing a continuously reinforced concrete pavement, wherein longitudinal reinforcing steel bars are overlappingly joined with each other.

So as to allow the reinforcing steel bars introduced into the guide tubes of the reinforcing steel bar introducing/fixing equipment 100 in front of the reinforcing steel bar introducing/fixing equipment 100 to be continuously joined longitudinally with each other, they are joined longitudinally with each other by means of couplers, not by means of conventional overlapping joint (See FIG. 5). Through the mechanical joint, the reinforcing steel bars can be introduced continuously into the guide tubes of the reinforcing steel bar introducing/fixing equipment 100 in a stable manner, thus shortening the whole period of construction, minimizing the amounts of reinforcing steel bars and labor, and reducing the occurrence of damage in the joined portion of the longitudinal reinforcing steel bars.

On the other hand, the paver 300 moves behind the reinforcing steel bar introducing/fixing equipment 100, while maintaining a given distance from the reinforcing steel bar introducing/fixing equipment 100, and desirably, the reinforcing steel bar introducing/fixing equipment 100 and the paver 300 are connected to each other so as to maintain the given distance therebetween.

At this time, the reinforcing steel bar introducing/fixing equipment 100 desirably has flattening means mounted on the rear portion thereof so as to allow the concrete cast on the road to be distributed transversely before it is flattened and finished by means of the paver 300. The flattening means includes various means such as, an auger, plower and so on.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A method for constructing a continuously reinforced concrete pavement, the method comprising:

a reinforcing steel bar arrangement step of longitudinally arranging, by reinforcing steel bar introducing/fixing equipment, reinforcing steel bars while moving the reinforcing steel bar introducing/fixing equipment, wherein the reinforcing steel bar introducing/fixing equipment includes guide tubes and a reinforcing steel bar holding apparatus, the guide tubes being adapted to guide the reinforcing steel bars to proper positions thereof, and the reinforcing steel bar holding apparatus being adapted to, when casting concrete, apply an instant tensile force to the reinforcing steel bars so that the reinforcing steel bars are not bent despite weight of the concrete cast thereon and are placed at the proper positions thereof, and wherein the reinforcing steel bars are serially introduced into the guide tubes from a front of the reinforcing steel bar introducing/fixing equipment (in a driving direction of the reinforcing steel bar introducing/fixing equipment), and the guide tubes are formed to be bent from a center of a road to both sides of the road so that the reinforcing steel bars introduced into the guide tubes are partially bent outward from the center of the road, thereby forming a space in the front of the reinforcing steel bar introducing/fixing equipment;

a concrete casting step of casting, by a concrete spreader, concrete on top of the reinforcing steel bars arranged in the reinforcing steel bar arrangement step, wherein the concrete spreader is located at the space formed in the front of the reinforcing steel bar introducing/fixing equipment (in the driving direction of the reinforcing steel bar introducing/fixing equipment), is driven along the road while the reinforcing steel bar introducing/fixing equipment is driven, and casts the concrete on top of the reinforcing steel bars arranged at the proper positions due to the instant tensile force applied by the guide tubes bent at a rear of the reinforcing steel bar introducing/fixing equipment; and a finishing step of flattening, by a paver, a surface of the concrete cast in the concrete casting step.

2. The method according to claim 1, wherein the reinforcing steel bars introduced into the guide tubes of the reinforcing steel bar introducing/fixing equipment in the front of the reinforcing steel bar introducing/fixing equipment are continuously joined longitudinally with each other by means of couplers.

3. The method according to claim 1, wherein the reinforcing steel bar holding apparatus of the reinforcing steel bar introducing/fixing equipment is driven in a roller or hydraulic pressure manner.

4. The method according to claim 1, wherein the guide tubes of the reinforcing steel bar introducing/fixing equipment become gradually small in diameter toward end portions of the guide tubes from which the reinforcing steel bars are guided and arranged.

5. The method according to claim 1, wherein the guide tubes of the reinforcing steel bar introducing/fixing equipment become upwardly inclined from the road.

6. The method according to claim 1, wherein the reinforcing steel bar introducing/fixing equipment and the paver, which follows the reinforcing steel bar introducing/fixing equipment, are connected to each other so that the reinforcing steel bar introducing/fixing equipment and the paver are driven together while maintaining a predetermined distance therebetween.

7. The method according to claim 1, wherein the reinforcing steel bar introducing/fixing equipment comprises flattening means mounted on a rear portion thereof so as to distribute in a transverse direction of the road the concrete cast at a rear of the reinforcing steel bar introducing/fixing equipment.

8. The method according to claim 7, wherein the flattening means comprises an auger or plower.

9. The method according to claim 1, wherein spacers are provided in a transverse direction of the road to hold the proper positions of the reinforcing steel bars when the reinforcing steel bars are initially arranged in the reinforcing steel bar arrangement step.

* * * * *